US009927743B2

(12) United States Patent
Oomoto et al.

(10) Patent No.: US 9,927,743 B2
(45) Date of Patent: Mar. 27, 2018

(54) FIXING DEVICE WITH A VARIABLE ROTATIONAL DRIVE

(71) Applicant: Konica Minolta, Inc., Chiyoda-ku, Tokyo (JP)

(72) Inventors: Noboru Oomoto, Toyokawa (JP); Tadayasu Sekioka, Toyohashi (JP); Sayaka Morita, Gamagori (JP); Keita Saito, Settsu (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/381,412

(22) Filed: Dec. 16, 2016

(65) Prior Publication Data

US 2017/0176903 A1 Jun. 22, 2017

(30) Foreign Application Priority Data

Dec. 16, 2015 (JP) ..... 2015-245567

(51) Int. Cl.
*G03G 15/20* (2006.01)

(52) U.S. Cl.
CPC ..... *G03G 15/2028* (2013.01); *G03G 15/2017* (2013.01); *G03G 15/2085* (2013.01); *G03G 2215/2045* (2013.01)

(58) Field of Classification Search
CPC ..... G03G 15/2028; G03G 15/2085; G03G 15/657; G03G 15/6588; G03G 2215/00413; G03G 2215/2045
USPC ..... 399/45, 68, 400; 219/216
See application file for complete search history.

(56) References Cited

U.S. PATENT DOCUMENTS

| | | | | |
|---|---|---|---|---|
| 7,454,150 | B2 * | 11/2008 | Matsuda | G03G 15/0131 399/301 |
| 8,488,986 | B2 * | 7/2013 | Dobbertin | G03G 15/2064 399/320 |
| 2008/0303202 | A1 * | 12/2008 | Noguchi | G03G 15/657 271/10.06 |
| 2014/0348527 | A1 * | 11/2014 | Murakami | G03G 15/2028 399/67 |
| 2015/0071667 | A1 * | 3/2015 | Hiroki | G03G 15/2014 399/68 |
| 2016/0018768 | A1 * | 1/2016 | Kinouchi | G03G 15/657 399/68 |

FOREIGN PATENT DOCUMENTS

| | | | | |
|---|---|---|---|---|
| JP | 57082877 A | * | 5/1982 | B65H 23/02 |
| JP | 02067580 A | * | 3/1990 | |
| JP | 06318009 A | * | 11/1994 | |
| JP | 2010256696 A | * | 11/2010 | G03G 15/6573 |
| JP | 2014-81610 A | | 5/2014 | |

* cited by examiner

*Primary Examiner* — Robert Beatty
(74) *Attorney, Agent, or Firm* — Buchanan Ingersoll & Rooney PC

(57) ABSTRACT

A fixing device is equipped with a lower pressure roller, an upper pressure roller and a fixing belt which fix a toner image onto a sheet, by holding and conveying the sheet by a nip portion, and a control unit which controls rotation of the lower pressure roller. The control unit periodically changes a velocity of rotational drive of the lower pressure roller, at a frequency of which a period is shorter than a time needed for the sheet to pass through the nip portion, when the sheet passes through the nip portion.

23 Claims, 10 Drawing Sheets

FIXING DEVICE WITH A VARIABLE ROTATIONAL DRIVE

The present U.S. patent application claims a priority under the Paris Convention of Japanese patent application No. 2015-245567 filed on Dec. 16, 2015, the entirety of which is incorporated herein by references.

BACKGROUND OF THE INVENTION

Field of the Invention

This invention relates to a fixing device. More specifically, this invention relates to a fixing device equipped with a first and a second rotating bodies to fix a toner image onto a sheet, by holding and conveying the sheet at a nip portion.

Description of the Related Art

As electrophotography image forming apparatuses, there are a MFP (Multi Function Peripheral) with a scanner function, a facsimile function, a copying function, a function of a printer, a data transmitting function and a server function, a facsimile device, a copying machine, a printer, and so on.

An image forming method of a generic image forming apparatus is as follow. An image forming apparatus electrostatically charges a photo conductor by using an electrostatic charging device. An electrostatic latent image is formed on the photo conductor by laser beams emitted from an expose device. The image forming apparatus forms a toner image by developing the electrostatic latent image by using a developing device. The toner image is transferred onto a sheet by using a transfer roller. The image forming apparatus forms the image onto a sheet by fixing the toner image onto the sheet by using a fixing device.

As for a fixing device of an image forming apparatus, to improve separability of sheets (especially, thin paper) and a gloss memory, a method to make a difference between velocities of surfaces of two parts which pinch and convey a sheet for fixing (for example, a lower pressure roller and a fixing belt) is proposed. According to this method, a sheet is separated from a fixing belt by shearing force which occurs between a toner image on the sheet and a surface layer of the fixing belt. Such the technique is disclosed in the below Document 1, for example.

Document 1 below discloses a structure in which an upper pressure roller and a lower pressure roller contact with each other via a fixing belt with pressure. A velocity difference is configured between a velocity of the surface of the lower pressure roller and a velocity of the surface of the fixing belt at a fixing nip portion where a sheet is pinched and conveyed. Under the velocity difference, the lower pressure roller and the fixing belt rotate, so that the paper sheet is fed.

[Document(s)]

[Document 1] Japan Patent Publication No. 2014-81610

Generally, the upper pressure roller is rotationally driven only for the purpose of heat leveling of the fixing belt when separating. However, according to the technique of Document 1, the upper pressure roller should be rotationally driven, keeping the configured velocity difference between the velocity of the surface of the upper pressure roller and the velocity of the surface of the lower pressure roller, when feeding paper. In consequence, the driving control system for the upper pressure roller gets complex, as compared with the conventional system, so that the manufacturing cost increases. On the other hand, according to the technique of Document 1, even though the driving control system gets complex and the manufacturing cost increases, the separability of sheets is unsatisfactory.

SUMMARY OF THE INVENTION

This invention is to solve the above problems. The object is to provide a fixing device which can effectively improve separability of sheets.

To achieve at least one of the abovementioned objects, according to an aspect, a fixing device reflecting one aspect of the present invention comprises: a first and a second rotating bodies that fixes a toner image to a sheet, by holding and conveying the sheet at a nip portion, and a control unit that controls at least rotation of the first rotating body, wherein the control unit periodically changes a velocity of rotational drive of the first rotating body, at a frequency of which a period is shorter than a time needed for the sheet to pass through the nip portion, when the sheet passes through the nip portion.

Preferably, each of the first and the second rotating bodies includes a core metal, and a viscoelastic layer which is formed on an outer circumference of the core metal.

Preferably, the control unit periodically changes the velocity of the rotational drive of the first rotating body, at the frequency of which a phase of the periodical change of the rotational speed of the core metal in the second rotating body delays with respect to a phase of the periodical change of the rotational speed of the core metal in the first rotating body.

Preferably, the control unit periodically changes the velocity of the rotational drive of the first rotating body, at the frequency of which the phase of the periodical change of the rotational speed of the core metal in the first rotating body is opposite to the phase of the periodical change of the rotational speed of the core metal in the second rotating body.

Preferably, the control unit fluctuates the frequency when the velocity of the rotational drive of the first rotating body periodically changes, within a required range of which a center value is a frequency at which the periodical change of the rotational speed of the core metal in the second rotating body resonates.

Preferably, the second rotating body further includes a flywheel attached to the core metal.

Preferably, the control unit periodically changes the velocity of the rotational drive of the first rotating body, at an amplitude and a frequency at which a phenomenon of sliding in which the sheet shifts with respect to the second rotating body at the nip portion does not occur.

Preferably, the control unit periodically changes the velocity of the rotational drive of the first rotating body, by at least one of a condition of an amplitude and a condition of a frequency which were decided in response to a friction coefficient of the sheet.

Preferably, the control unit makes the amplitude when the velocity of the rotational drive of the first rotating body periodically changes constant, regardless of the friction coefficient of the sheet, and makes a frequency when the velocity of the rotational drive of the first rotating body periodically changes larger, when the friction coefficient of the sheet is larger.

Preferably, the control unit makes the frequency when the velocity of the rotational drive of the first rotating body periodically changes constant, regardless of the friction coefficient of the sheet, and makes an amplitude when the velocity of the rotational drive of the first rotating body periodically changes larger, when the friction coefficient of the sheet is larger.

Preferably, the control unit periodically changes the velocity of the rotational drive of the first rotating body, by at least one of a condition of an amplitude and a condition of a frequency which were decided in response to a basis weight of the sheet.

Preferably, the control unit makes the amplitude when the velocity of the rotational drive of the first rotating body periodically changes constant, regardless of the basis weight of the sheet, and makes a frequency when the velocity of the rotational drive of the first rotating body periodically changes larger, when the basis weight of the sheet is larger.

Preferably, the control unit makes the frequency when the velocity of the rotational drive of the first rotating body periodically changes constant, regardless of the basis weight of the sheet, and makes an amplitude when the velocity of the rotational drive of the first rotating body periodically changes larger, when the basis weight of the sheet is larger.

Preferably, the control unit periodically changes the velocity of the rotational drive of the first rotating body, by at least one of a condition of an amplitude and a condition of a frequency which were decided in response to a process speed of the fixing device.

Preferably, the control unit makes the amplitude when the velocity of the rotational drive of the first rotating body periodically changes constant, regardless of the process speed of the fixing device, and makes a frequency when the velocity of the rotational drive of the first rotating body periodically changes larger, when the process speed of the fixing device is faster.

Preferably, the control unit makes the frequency when the velocity of the rotational drive of the first rotating body periodically changes constant, regardless of the process speed of the fixing device, and makes an amplitude when the velocity of the rotational drive of the first rotating body periodically changes larger, when the process speed of the fixing device is faster.

Preferably, the control unit periodically changes the velocity of the rotational drive of the first rotating body, by at least one of a condition of an amplitude and a condition of a frequency which were decided in response to a fixing temperature configured in the fixing device.

Preferably, the control unit makes the amplitude when the velocity of the rotational drive of the first rotating body periodically changes constant, regardless of the fixing temperature configured in the fixing device, and makes a frequency when the velocity of the rotational drive of the first rotating body periodically changes larger, when the fixing temperature configured in the fixing device is lower.

Preferably, the control unit makes the frequency when the velocity of the rotational drive of the first rotating body periodically changes constant, regardless of the fixing temperature configured in the fixing device, and makes an amplitude when the velocity of the rotational drive of the first rotating body periodically changes larger, when the fixing temperature configured in the fixing device is lower.

Preferably, the control unit periodically changes the velocity of the rotational drive of the first rotating body when an anterior end of a conveying direction of the sheet is passing through the nip portion, and does not periodically change the velocity of the rotational drive of the first rotating body during at least a part of time from when the anterior end of the conveying direction of the sheet finished passing through the nip portion to when a posterior end of the conveying direction of the sheet finishes passing through the nip portion.

Preferably, the second rotating body includes a heating roller, a fixing roller, and an endless fixing belt which is laid over the heating roller and the fixing roller, and the first rotating body contacts the fixing roller with pressure via the fixing belt, and forms the nip portion with the fixing belt.

Preferably, the control unit does not rotationally drive the second rotating body when the sheet passes through the nip portion.

Preferably, the control unit rotationally drives the second rotating body when the sheet passes through the nip portion.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

[A Structure of an Image Forming Apparatus]

Figure 1:
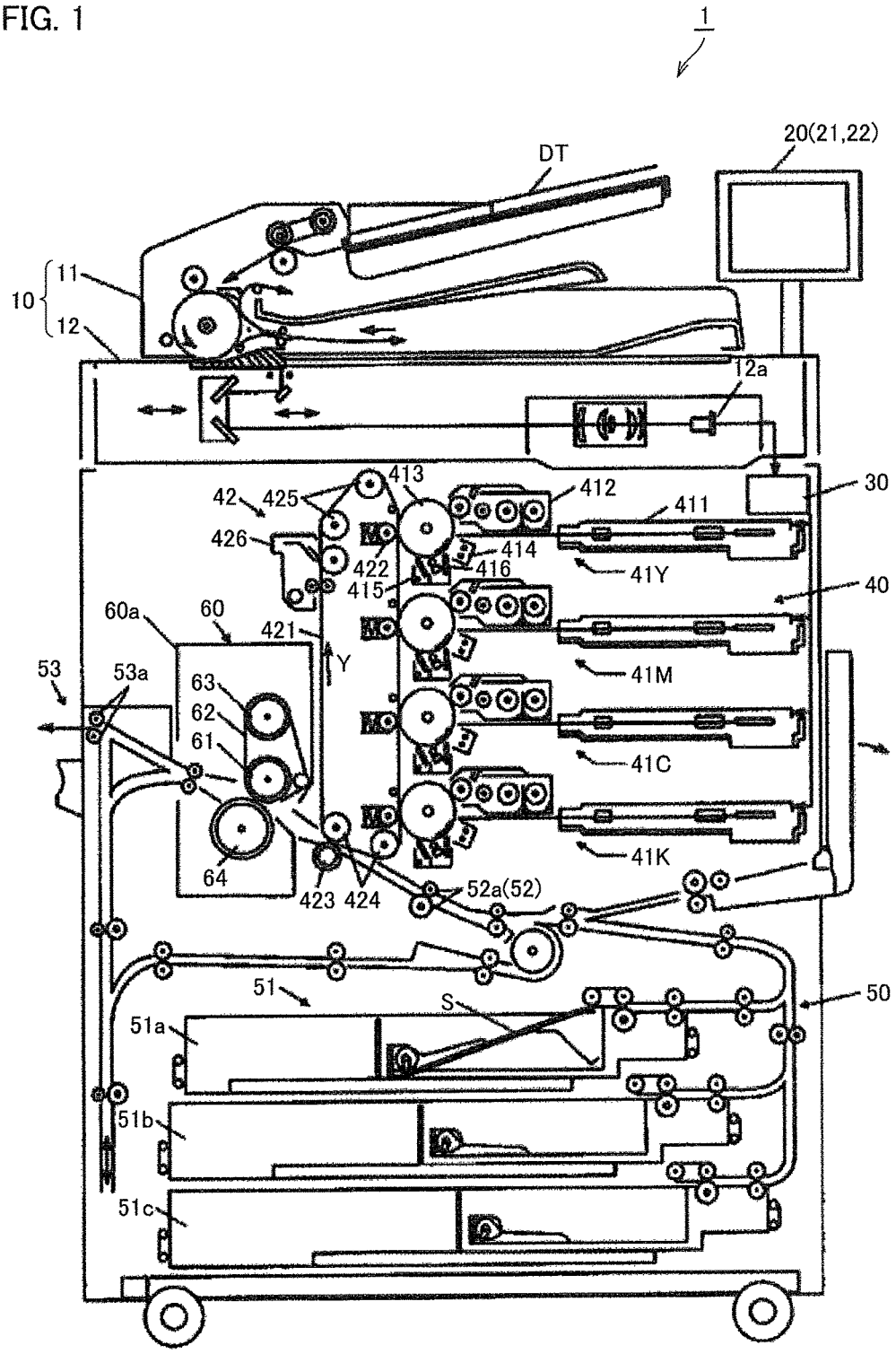
FIG. 1 shows a cross sectional view of a structure of image forming apparatus 1 equipped with fixing device 60, according to the embodiment of this invention.
Figure 2:
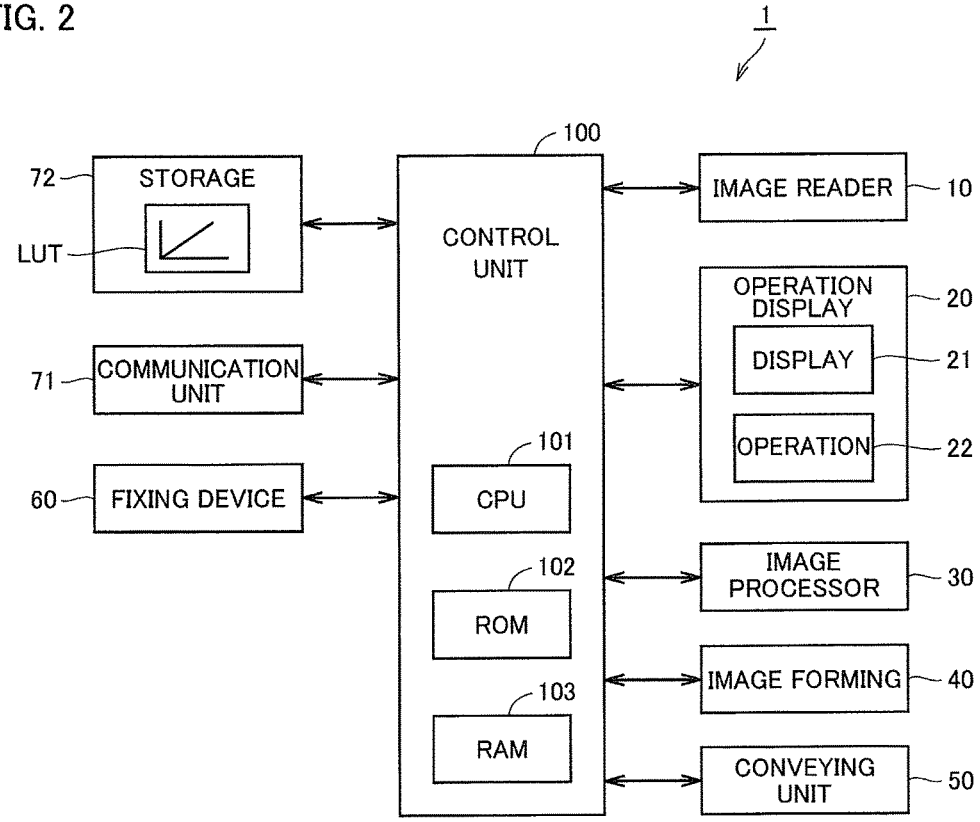
FIG. 2 shows a block diagram of the control structure of image forming apparatus 1 equipped with fixing device 60, according to the embodiment of this invention.

FIG. 1 shows a cross sectional view of a structure of image forming apparatus 1 equipped with fixing device 60, according to the embodiment of this invention. FIG. 2 shows a block diagram of the control structure of image forming apparatus 1 equipped with fixing device 60, according to the embodiment of this invention.

Referring to FIGS. 1 and 2, image forming apparatus 1 is a color MFP which adopts an intermediate transfer method, using an electrophotographic process technique. More specifically, image forming apparatus 1 transfers toner images of colors of C (cyan), M (magenta), Y (yellow) and K (black) formed on photo conductors to an intermediate transfer member (the primary transfer). Next, the four-color toner images are overlapped on the intermediate transfer member, and transferred onto a sheet (the secondary transfer), to form an image.

Image forming apparatus 1 adopts a tandem system, in which photo conductors corresponding to four colors of CMYK are arranged parallel to the moving direction of the intermediate transfer member, in series. By one procedure of the intermediate transfer member, the toner images of the colors are transferred in series.

Image forming apparatus 1 is equipped with image reading device 10, operation display unit 20, image processing unit 30, image forming unit 40, conveying unit 50, fixing device 60, communication unit 71, storage unit 72, and control unit 100.

Control unit 100 includes CPU (Central Processing Unit) 101, ROM (Read Only Memory) 102, RAM (Random Access Memory) 103, and so on. CPU 101 reads programs corresponding to the processing details from ROM 102, and expands the same in RAM 103, and centrally controls behavior of each blocks of image forming apparatus 1 in cooperation with the expanded programs. At this time, CPU 101 refers to various data stored in storage unit 72. Storage unit 72 stores various data. Storage unit 72 is configured with, for example, a non-volatile semiconductor memory (so-called a flash memory), a hard disk drive, and so on.

Control unit 100 transmits and receives various data with external devices (for example, PCs (Personal Computers) or the like) which are connected with a communication network such as a LAN (Local Area Network), a WAN (Wide Area Network), or the like, via communication unit 71. Control unit 100 receives image data transmitted from the external device, for example. Control unit 100 forms images on sheets based on the image data (image data input). Communication unit 71 is configured with a communication control card, such as a LAN card.

Image reading device 10 includes automatic document paper feeding device 11 which is called an ADF (Auto Document Feeder), document images scanning device (a scanner) 12, and so on. Automatic document paper feeding device 11 conveys documents DT stacked on a document tray to document images scanning device 12 by a conveying mechanism. Automatic document paper feeding device 11 can read images (includes images of both sides) once for all of many documents DT stacked on the document tray in series. Document images scanning device 12 optically scans a document conveyed onto a contact glass from automatic document paper feeding device 11 or a document placed on the contact glass, and forms the image of reflected light from the document on an acceptance surface of CCD (Charge Coupled Device) sensor 12*a* to read the document image. Image reading device 10 generates input image data based on reading result of document images scanning device 12. Image processing unit 30 performs predetermined images process on the input image data.

Operation display unit 20 is configured with a liquid crystal display (LCD: Liquid Crystal Display) with a touch panel, for example, to act as display unit 21 and operation unit 22. Display unit 21 displays various operation screens, states of images, behavior situation of functions, and so on, based on display control signals input from control unit 100. Operation unit 22 includes various operation keys, such as a numerical keypad, a start key. Operation unit 22 receives various input operations from users, and outputs operation signals to control unit 100.

Image processing unit 30 includes a circuit and so on which executes digital image processing corresponding to an initial configuration or a user configuration, with respect to the input image data. Image processing unit 30 performs various correction processes, such as a gradation correction, a color correction, a shading correction, a compression process or the like with respect to the input image data, under the control of control unit 100, for example. The image forming unit 40 is controlled based on the processed image data.

Image forming unit 40 includes image forming units 41Y, 41M, 41C and 41K, intermediate transfer unit 42, and so on. The image forming units 41Y, 41M, 41C and 41K form images of colored toner of the Y component, the M component, the C component, and the K component based on the input image data.

Image forming units 41Y, 41M, 41C, and 41K of the Y component, the M component, the C component, and the K component have a same structure, except for the color of the toner. For the sake of simplicity of illustration and explanation, same referential characters are provided for the same composing elements. When discriminating among them, Y, M, C or K is attached to the referential characters. In FIG. 1, as for image forming units, referential characters are provided only for composing elements of image forming unit 41Y for the Y component. Referential characters of composing elements for other image forming units 41M, 41C, and 41K are omitted.

Each of image forming units 41Y, 41M, 41C, and 41K includes expose device 411, developing device 412, photo conductor drum 413, electrostatic charging device 414, drum cleaning device 415, lubricant application device 416, and so on.

A photo conductor drum 413 is an organic photo conductor (OPC: Organic Photo-conductor) of a negative electrostatic charging type, in which an under-coat layer (UCL: Under Coat Layer), an electrical charge generation layer (CGL: Charge Generation Layer), and an electrical charge transport layer (CTL: Charge Transport Layer) are stacked in series, on a periphery of an electric conductive cylindrical body made of aluminum (an aluminum element tube), for example.

Electrostatic charging device 414 electrostatically charges the surface of photo conductor drum 413 which is photoconductive, for uniform negative charging. Expose device 411 is configured with a semiconductor laser, for example. Expose devices 411 irradiate photo conductor drums 413 with laser beams corresponding to images of color components. Positive electrical charges occur at the electrical charge generation layer of photo conductor drum 413. The positive electrical charges are transported to the surface of the electrical charge transport layer. Hence, the electrical charges (negative electrical charges) of the surface of photo conductor drum 413 are neutralized. On the surfaces of photo conductor drums 413, electrostatic latent images for color components are formed by difference in electrical potential from the surround.

Developing devices 412 store developers for color components (for example, two components developer which consists of small grain sized toner and magnetic material).

Developing devices 412 attach toners of color components to the surfaces of photo conductor drums 413, to make the electrostatic latent images visible and form toner images.

Here, toner stored in developing devices 412 is toner including wax (oil less toner), in which the toner particles include dispersed wax. The melting point of the wax in the toner is normally equal to or less than around 110 degree Celsius, which is a low temperature. As the wax, for example, such as paraffin wax, polyolefin wax, modified materials of them (for example, oxidation products, a graft treated materials, and so on), higher fatty acid and metallic salt of the same, amide wax, ester series wax, and so on, which are as conventional public knowledge, can be used. Further, higher fatty acid ester wax may be used as preferable wax, for example.

Drum cleaning device 415 includes a drum cleaning blade (hereinafter referred to as a DCL blade) which is brought into slide-contact with the surface of photo conductor drum 413. After the primary transfer, the transfer remaining toner which remains on the surface of photo conductor drum 413 is scraped by the DCL blade, to be removed.

Lubricant application device 416 includes a lubricant application brush which has a roller shape and is brought into slide-contact with the surface of photo conductor drum 413. With rotation of photo conductor drum 413, the lubricant adhered to the lubricant application brush is applied to the surface of photo conductor drum 413.

Intermediate transfer unit 42 includes intermediate transfer belt 421 which is an intermediate transfer member, primary transfer roller 422, secondary transfer roller 423, drive rollers 424, driven rollers 425, belt cleaning device 426, and so on.

Intermediate transfer belt 421 is configured with an endless belt, and is laid over drive rollers 424 and driven rollers 425. Intermediate transfer belt 421 moves with rotation of drive rollers 424, in the direction shown by arrow Y, at a constant velocity. When intermediate transfer belt 421 contacts photo conductor drum 413 with pressure by action of primary transfer roller 422, toner images for colors are overlapped in series on intermediate transfer belt 421, by the primary transferring. After that, when intermediate transfer belt 421 contacts sheet S with pressure by action of secondary transfer roller 423, the toner image primary transferred to intermediate transfer belt 421 is secondary transferred to sheet S.

Belt cleaning device 426 has a belt cleaning blade (hereinafter referred to as a BCL blade) which is brought into slide-contact with the surface of intermediate transfer belt 421. After the secondary transfer, the transfer remaining toner which remains on the surface of intermediate transfer belt 421 is scraped by the BCL blade, to be removed.

In this manner, an unfixed toner image is formed on sheet S.

The unfixed toner image is fixed by fixing device 60 on sheet S. Fixing device 60 fixes the unfixed toner image on sheet S by heating and applying pressure on conveyed sheet S. Fixing device 60 fixes the sheet by a belt nip method. Fixing device 60 mainly includes the upper pressure roller 61 as a fixing roller, and the lower pressure roller 64 as a pressure roller, stored in frame 60*a*. The detailed structure of fixing device 60 will be explained later.

Conveying unit 50 includes paper feeding unit 51, conveying mechanism 52, paper ejection unit 53, and so on. Three paper feeding tray units 51*a* to 51*c* which form paper feeding unit 51 store sheets (standard sheets, specialty sheets) S recognized based on the basis weight, the size, or the like of the sheets, being categorized by the types beforehand configured.

Sheets S stored in paper feeding tray units 51*a* to 51*c* are fed one by one from the top, and conveyed to image forming unit 40 by conveying mechanism 52 which has a plurality of conveying rollers such as register roller 52*a*. At this time, skew of sheet S being conveyed is corrected and the conveying timing is adjusted by the register unit in which register roller 52*a* is installed.

In the image forming unit 40, a toner image on intermediate transfer belt 421 is secondary transferred to one side of sheet S in a lump. In fixing device 60, a fixing process is performed. Sheet S on which the image was formed is ejected to outside of the apparatus, by paper ejection unit 53 which has paper ejection roller 53*a*.

As described above, image forming apparatus 1 is equipped with photo conductor drum 413 which is photoconductive, electrostatic charging device 414 which uniformly electrostatic charges the surface of photo conductor drum 413, expose device 411 to form an electrostatic latent image by light irradiation, on the surface of photo conductor drum 413, developing device 412 which attaches toner to the surface of photo conductor drum 413 to make the electrostatic latent image visible and form a toner image, and intermediate transfer unit 42 to transfer the toner image onto a transfer target body, such as intermediate transfer belt 421, and sheet S.

Figure 3:
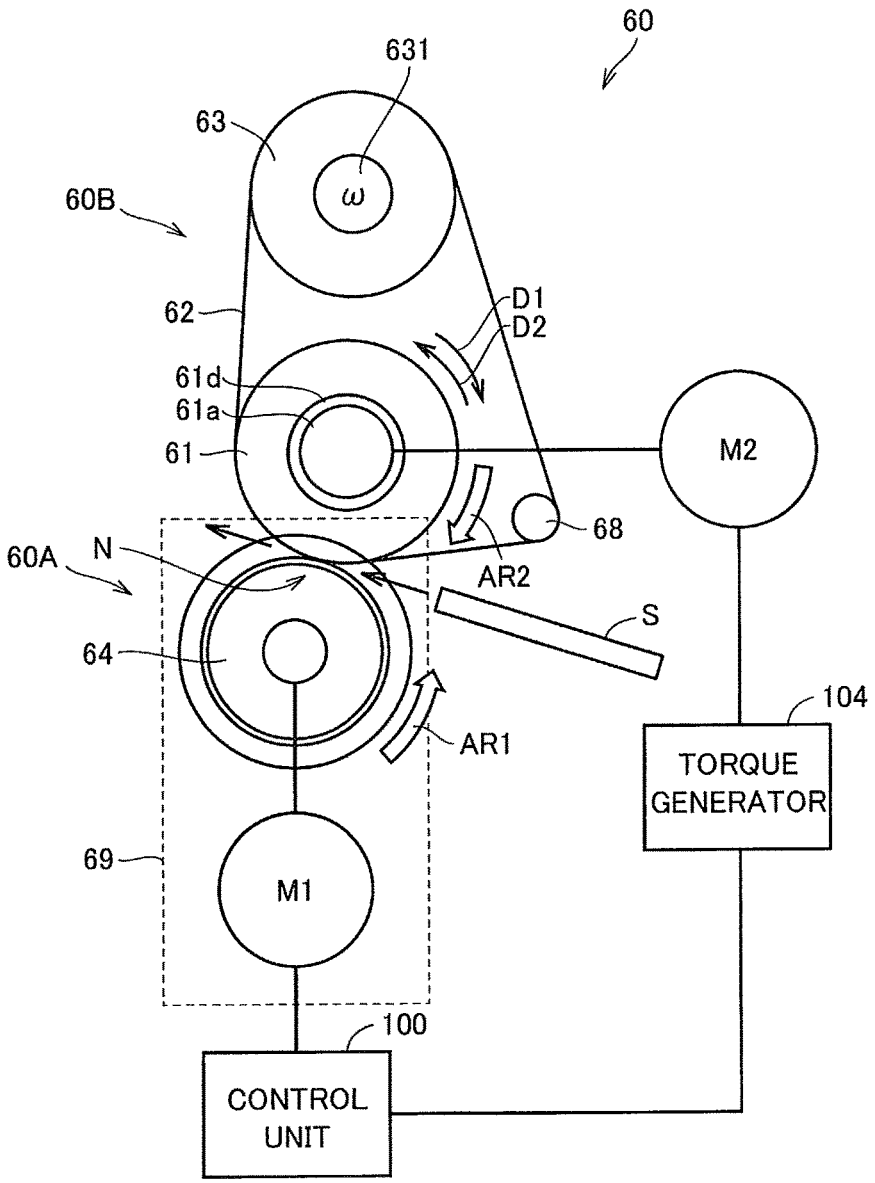
FIG. 3 shows a cross sectional view of a structure of fixing device 60.

FIG. 3 shows a cross sectional view of a structure of fixing device 60.

Referring to FIG. 3, fixing device 60 is a two axes upper belt type fixing device. Fixing device 60 includes lower pressure applying unit 60A and upper pressure applying unit 60B. Lower pressure applying unit 60A includes the lower pressure roller 64 (an example of a first rotating body), fixing pressure switching mechanism 69, and motor M1. Upper pressure applying unit 60B includes the upper pressure roller 61, fixing belt 62, heating roller 63, stretching part 68, and motor M2.

Lower pressure roller 64, upper pressure roller 61 and fixing belt 62 (an example of a second rotating body) hold and convey sheet S at nip portion N, so that a toner image is fixed on sheet S. Lower pressure roller 64 contacts upper pressure roller 61 with pressure via fixing belt 62.

Lower pressure roller 64 contacts upper pressure roller 61 with pressure via fixing belt 62 by fixing pressure switching mechanism 69. Lower pressure roller 64 forms nip portion N with fixing belt 62. Lower pressure roller 64 is rotationally driven by motor M1 in the direction shown by arrow AR1. Control unit 100 executes driving controls of motor M1 (for example, controls of turning the rotation ON/OFF, the number of rotations, pressure contact/separation with respect to the lower pressure roller 64, and so on), to control the rotation of lower pressure roller 64. Lower pressure roller 64 may include a built-in heat source, such as a halogen heater.

Fixing pressure switching mechanism 69 energizes lower pressure roller 64 toward upper pressure roller 61. Fixing pressure switching mechanism 69 can switch load for pressing lower pressure roller 64 against upper pressure roller 61 in multistep, based on the paper type, the basis weight, the size or the like of sheet S used for the image forming. Control unit 100 controls drive of fixing pressure switching mechanism 69.

Further, fixing pressure switching mechanism 69 changes the location of lower pressure roller 64. Herewith, even though when upper pressure roller 61 expands by temperature increment of the surface of fixing belt 62, and the external diameter increases, the location of the lower pressure roller 64 and the location of stretching part 68 is changed in accordance with the expansion. Herewith, nip portion N can move to the suitable location.

Upper pressure roller 61 and fixing belt 62 are driven by lower pressure roller 64, and rotate in the direction shown by arrow AR2. Fixing belt 62 is an endless belt, and laid over heating roller 63, upper pressure roller 61, and stretching part 68. Fixing belt 62 makes contact with sheet S on which a toner image was transferred, to heat sheet S at a predetermined temperature. Here, the predetermined temperature is a temperature which can supply an amount of heat necessary for melting toner, when sheet S passes through nip portion N. The predetermined temperature is changed in response to the type or the like of a sheet on which the image is formed.

Fixing belt 62 has a structure in which an elastic layer which consists of silicone rubber or the like, a surface release layer which consists of fluorine resin are stacked in order, on an outer periphery of a base film which consists of thermal resistance polyimide, for example. The fluorine resin consists of material including PFA (Perfluoro alkoxy alkane), PTFE (polytetra fluoro ethylene), or FEP (Perfluoro ethylene propylene copolymer). The fluorine resin preferably consists of PFA, PTFE, or FEP. Herewith, releasability of the surface of fixing belt 62 with respect to wax included in toner resin or toner particles is improved, and adhesion of toner on the surface of fixing belt 62 when fixing can be avoided.

Upper pressure roller 61 includes a column-shaped core metal which consists of iron or the like, and an elastic layer which consists of silicone rubber or the like, formed on the outer periphery of the core metal. The upper pressure roller 61 may further include a surface release layer which consists of fluorine resin, formed on the outer periphery of the elastic layer.

Heating roller 63 heats fixing belt 62, so that sheet S which is pinched by nip portion N is heated at a predetermined temperature by fixing belt 62. Heating roller 63 includes a cylindric core metal which consists of aluminium or the like, and a resin layer which consists of PTFE or the like, formed on the outer periphery of the core metal.

Heating roller 63 includes built-in heat source 631, such as a halogen heater. Heat source 631 heats the core metal and the resin layer in heating roller 63, under the control of control unit 100, to heat fixing belt 62. Fixing belt 62 may be heated by electromagnetic induction heating (IH: Induction Heating). In this instance, the base substance in fixing belt 62 may consist of material which can generate electromagnetic induction heat, such as Ni (nickel).

Stretching part 68 consists of a roller of which the both ends are rotatably supported. The external diameters of the both ends are larger than the central part. Namely, stretching part 68 has an inverted crown shape. Stretching part 68 is provided movable. Stretching part 68 adjusts tension of fixing belt 62, by the movement of stretching part 68. The tension of fixing belt 62 may be adjusted by fixing stretching part 68 and making heating roller 63 movable.

[A Control Method of the Fixing Device]

Figure 4:
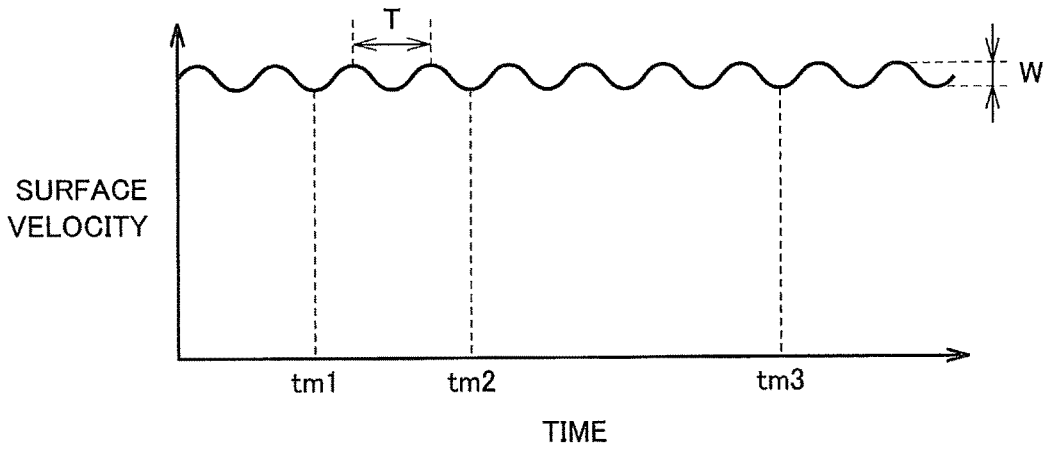
FIG. 4 shows a graph schematically indicates alteration of the velocity of the surface of the lower pressure roller 64 from moment to moment, when sheet S passes through nip portion N.

FIG. 4 shows a graph schematically indicates alteration of the velocity of the surface of the lower pressure roller 64 from moment to moment, when sheet S passes through nip portion N.

Referring to FIG. 4, control unit 100 superimposes a velocity fluctuation which has a small period (for example, like a sine waveform) on the rotational speed of lower pressure roller 64, when sheet S passes through nip portion N. The "small period" means a period shorter than the time needed for sheet S to pass through the nip portion (the nip time).

Namely, control unit 100 periodically changes a velocity of the rotational drive of lower pressure roller 64, with frequency of which the period is shorter than the time needed for sheet S to pass through the nip portion (the nip time), when sheet S passes through nip portion N. The nip time is calculated based on the process speed of the image forming apparatus and the length of nip portion N in the conveying direction.

Hereinafter, periodically changing of a velocity of the rotational drive of the rotating body may be referred to as "oscillation of the rotation of the rotating body". The periodical change of the rotational speed of the rotating body may be referred to as "the oscillation rotation of the rotating body". The frequency when a velocity of the rotational drive of the rotating body periodically changes may be referred to as "the oscillation frequency". According to FIG. 4, the amplitude of oscillation of the rotation of lower pressure roller 64 is amplitude W. The period is shown as period T. The oscillation frequency is defined as the reciprocal of period T.

For example, when the process speed is 300 mm/s, and the nip length is 15 mm, the nip time is 0.05 s. In this instance, period T of the oscillation of the rotation of the lower pressure roller 64 is configured less than 0.05 s, and the oscillation frequency of the lower pressure roller 64 is configured more than 20 Hz.

Control unit 100 should perform the rotational oscillation of the lower pressure roller 64, at least when the anterior end of sheet S in the conveying direction is passing through nip portion N. More specifically, the phrase of "when the anterior end of sheet S in the conveying direction is passing through nip portion N" means the period from clock time tm1 when the anterior end of sheet S in the conveying direction begins to pass through nip portion N to clock time tm2 when the anterior end of sheet S in the conveying direction finishes passing through nip portion N.

Control unit 100 may not perform the rotational oscillation of the lower pressure roller 64 and may drive the lower pressure roller 64 at a constant rotational speed, at least a part of the time from the clock time tm2 to clock time tm3 when the posterior end of sheet S in the conveying direction finishes passing through nip portion N.

Further, control unit 100 may perform the rotational oscillation of the lower pressure roller 64, from clock time tm1 to clock time tm3.

Further, control unit 100 may perform the rotational oscillation of the lower pressure roller 64 at all times during image forming, regardless of the passing location of sheet S, as shown by FIG. 4.

On the other hand, control unit 100 rotationally drives the upper pressure roller 61, in the state in which fixing belt 62 is separated from the lower pressure roller 64 (when the nip is in a separate state). Its purpose is to warm uniformly fixing belt 62 and the upper pressure roller 61, by heat which occurs at heating roller 63. The velocity of the surface of fixing belt 62 when the nip is in a separate state is configured slower than the velocity of the surface of the lower pressure roller 64.

According to the embodiment, control unit 100 does not control rotation of the upper pressure roller 61 (does not rotationally drive the upper pressure roller 61) when sheet S is passing through nip portion N, and makes fixing belt 62 contact with the lower pressure roller 64 with pressure.

Herewith, the upper pressure roller 61 and fixing belt 62 are rotationally driven with respect to the lower pressure roller 64. To make the rotationally driven of the upper pressure roller 61 easier, a one-way clutch may be provided in a drive system between motor M2 and the upper pressure roller 61.

Referring to FIGS. 3 and 4, as an alternative control method of the upper pressure roller 61, when sheet S passes through nip portion N, control unit 100 may control the rotation of the upper pressure roller 61 (may rotationally drive the upper pressure roller 61). More specifically, control unit 100 may apply torque for rotating the upper pressure roller 61 in direction opposite to the positive rotation to the upper pressure roller 61 which rotates following the lower pressure roller 64, to generate braking force D2 with respect to rotation in the conveying direction of the lower pressure roller 64 (a brake control). Control unit 100 may apply torque for supporting the upper pressure roller 61 which rotates following the lower pressure roller 64, to generate subsidiary driving force D1 which rotates the upper pressure roller 61 in the direction same as the conveying direction (an assist control). When performing the brake control or the assist control of the upper pressure roller 61, separability of sheets can be improved. Further, a gloss memory can be improved.

Figure 5:
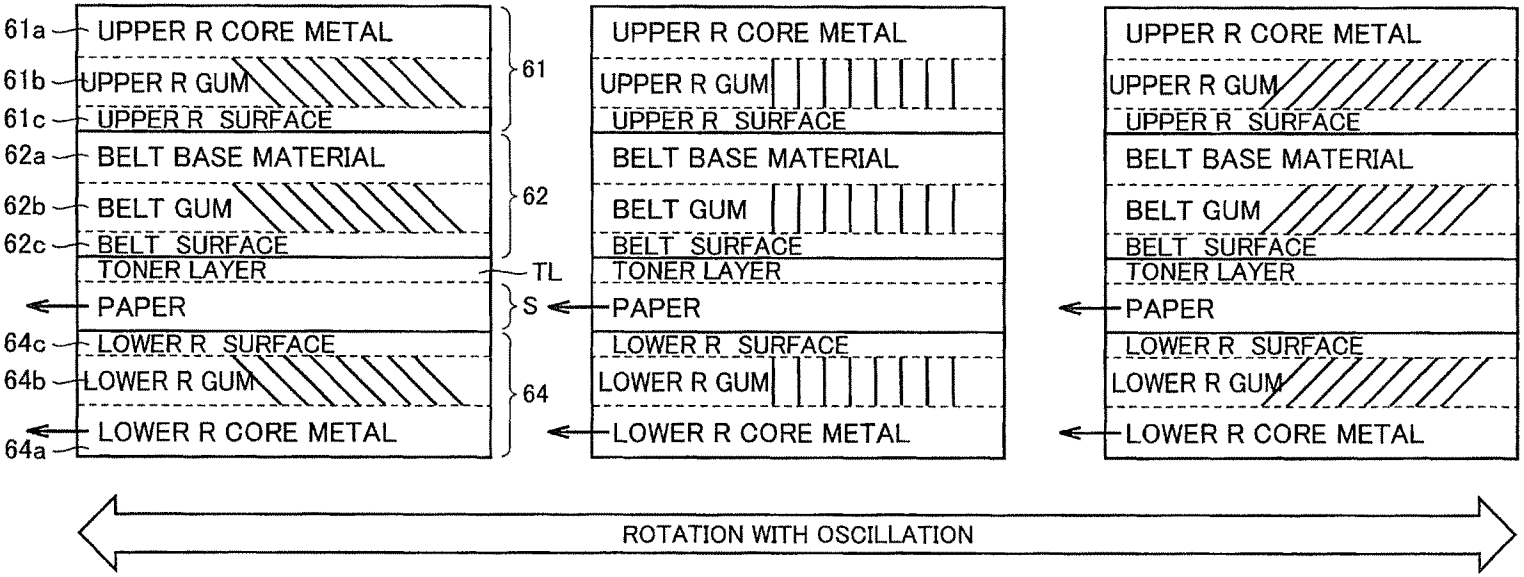
FIG. 5 shows a cross sectional view to schematically indicate the direction of the inner part distortion of each of the upper pressure roller 61, fixing belt 62, and the lower pressure roller 64.

FIG. 5 shows a cross sectional view to schematically indicate the direction of the inner part distortion of each of the upper pressure roller 61, fixing belt 62, and the lower pressure roller 64. For the convenience of explanation, thickness of each layer in FIG. 5 is different from the actual thickness. In the diagrams (a), (b), and (c) of FIG. 5, sheet S is conveyed left in FIG. 5.

Referring to FIG. 5, the upper pressure roller 61 includes core metal 61*a* which is rotationally driven by motor M2, rubber layer 61*b* (an example of a viscoelastic layer) formed on the outer circumference side of core metal 61*a*, and surface layer 61*c* formed on the outer circumference side of rubber layer 61*b*. Fixing belt 62 includes base material 62*a*, rubber layer 62*b* (an example of a viscoelastic layer) formed on the outer circumference side of base material 62*a*, and surface layer 62*c* formed on the outer circumference side of rubber layer 62*b*. Lower pressure roller 64 includes core metal 64*a* which is rotationally driven by motor M1, rubber layer 64*b* (an example of a viscoelastic layer) formed on the outer circumference side of core metal 64*a*, and surface layer 64*c* formed on the outer circumference side of rubber layer 64*b*. Each of rubber layers 61*b*, 62*b* and 64*b* has a viscoelastic character, and each of the rubber layers may be referred to as a "gum" layer. Sheet S is pinched between surface layer 62*c* and surface layer 64*c*. Toner layer TL is formed on the side of surface layer 62*c* of sheet S.

When the lower pressure roller 64 and the upper pressure roller 61 are rotating at a constant speed, the rotational load of the lower pressure roller 64 received from the upper pressure roller 61 lowers without limit. In this instance, as shown by FIG. 5(*b*), strain does not occur in rubber layers 61*b*, 62*b* and 64*b*.

When the lower pressure roller 64 rotates faster than the upper pressure roller 61, or braking force D2 (FIG. 3) is applied to the upper pressure roller 61, the rotational load of the lower pressure roller 64 received from the upper pressure roller 61 increases. In this instance, as shown in FIG. 5(*c*), strain occurs in rubber layers 61*b*, 62*b* and 64*b*, so that rubber layers 61*b*, 62*b* and 64*b* are inclined in a direction opposite to the conveying direction. In consequence, shearing force occurs between toner layer TL and fixing belt 62, wherein the shearing force pulls sheet S and toner layer TL in a direction opposite to the conveying direction.

When the lower pressure roller 64 rotates slower than the upper pressure roller 61 (when the lower pressure roller 64 slows down, and the upper pressure roller 61 maintains the fast rotation by inertia force), or subsidiary driving force D1 (FIG. 3) is applied to the upper pressure roller 61, the rotational load of the lower pressure roller 64 received from the upper pressure roller 61 increases. In this instance, as shown by FIG. 5(*a*), strain occurs in rubber layers 61*b*, 62*b* and 64*b*, so that rubber layers 61*b*, 62*b* and 64*b* are inclined in the conveying direction. In consequence, shearing force occurs between toner layer TL and fixing belt 62, wherein the shearing force pulls sheet S and toner layer TL in the conveying direction.

The force which toner layer TL received from surface layer 62*c* can be controlled by the rotational load of the upper pressure roller 61, or the brake/assist driving control. Rubber layers 61*b*, 62*b* and 64*b* have a viscoelastic character in the conveying direction (shearing direction). Therefore, when performing the rotational oscillation on the lower pressure roller 64, it requires time to transmit the fluctuation of the rotational speed of core metal 64*a* in the lower pressure roller 64 to core metal 61*a* in the upper pressure roller 61, so that a phase delay occurs at rotational speed of core metal 61*a* in the upper pressure roller 61. In consequence, shearing force is applied between toner layer TL and fixing belt 62.

[Transmission of Oscillation of Rotation, from the Lower Pressure Roller to the Upper Pressure Roller]

Figure 6:
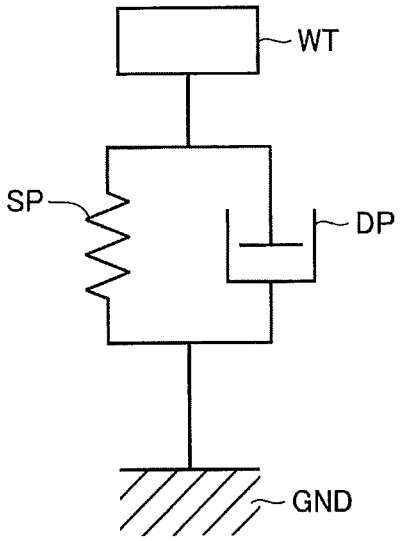
FIG. 6 shows a model schematically indicates a structure in which the rotational oscillation is transmitted from core metal 64*a* of the lower pressure roller 64 to core metal 61*a* of the upper pressure roller 61.

FIG. 6 shows a model schematically indicates a structure in which the rotational oscillation is transmitted from core metal 64*a* of the lower pressure roller 64 to core metal 61*a* of the upper pressure roller 61. The structure shown in FIG. 6 is just a model. The actual structure is more complicated than the structure of FIG. 6.

Referring to FIG. 6, according to the embodiment, core metal 64*a* in the lower pressure roller 64 oscillates in the rotational direction. The oscillation is transmitted to core metal 61*a* of the upper pressure roller 61. Therefore, ground GND corresponds to core metal 64*a* in the lower pressure roller 64, and weight WT corresponds to core metal 61*a* of the upper pressure roller 61. Rubber layers 61*b*, 62*b* and 64*b* present between core metal 64*a* in the lower pressure roller 64 and core metal 61*a* of the upper pressure roller 61 correspond to spring SP and dashpot DP which have viscoelastic characteristics.

When the structure which transmits the rotational oscillation from core metal 64*a* in the lower pressure roller 64 to core metal 61*a* of the upper pressure roller 61 is a one inertia type model as shown in FIG. 6, the oscillation transmission characteristics are simple as shown in FIG. 6.

Figure 7:
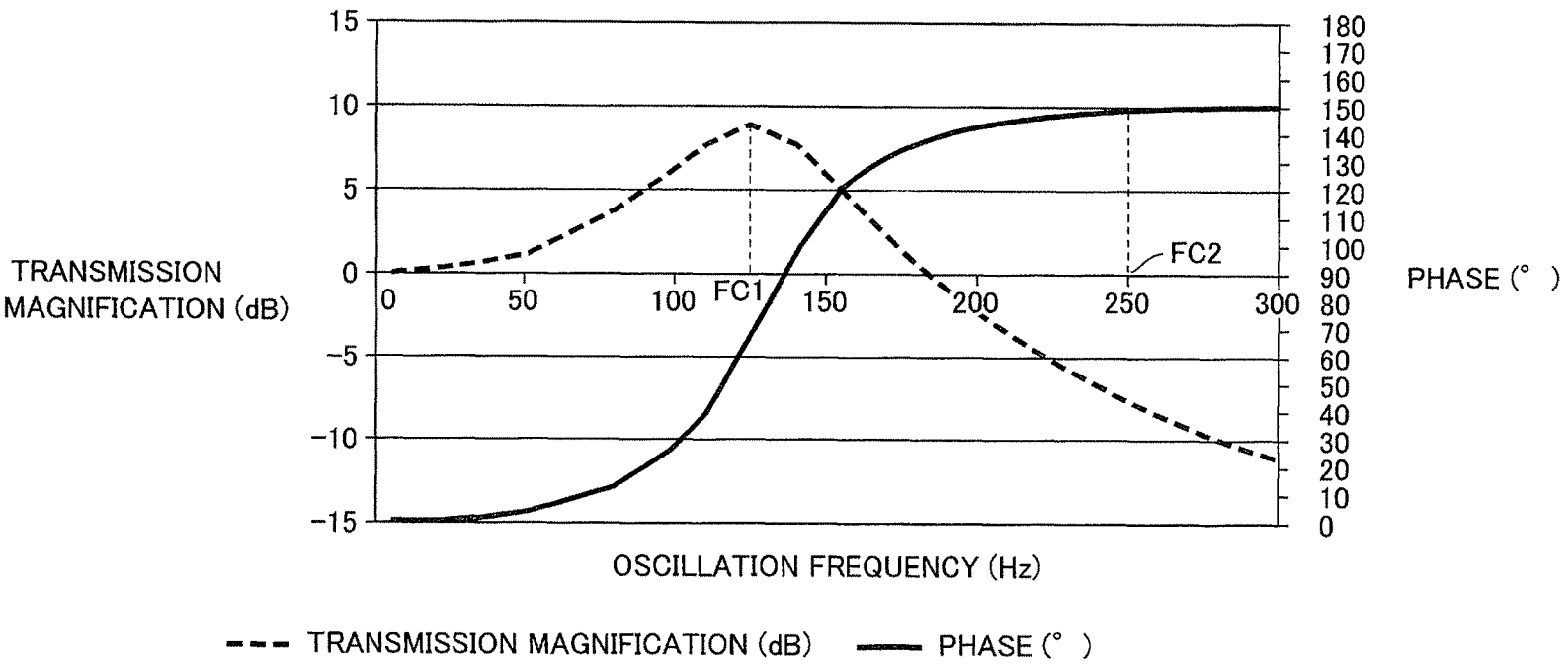
FIG. 7 shows a graph indicating oscillation transmission characteristics of parts which have viscoelastic characteristics.

FIG. 7 shows a graph indicating oscillation transmission characteristics of parts which have viscoelastic characteristics. The horizontal axis in FIG. 7 shows an oscillation frequency of core metal 64*a* in the lower pressure roller 64. The vertical axis in FIG. 7 shows a transmission magnification ratio and the phase. The transmission magnification ratio shows how many times the amplitude of oscillation of the rotation of core metal 61*a* of the upper pressure roller 61 is larger than the amplitude of oscillation of the rotation of core metal 64*a* in the lower pressure roller 64. The phase shows a phase delay of oscillation of the rotation of core metal 61*a* of the upper pressure roller 61 with respect to the phase of oscillation of the rotation of core metal 64*a* in the lower pressure roller 64.

Referring to FIG. 7, FIG. 7 will be explained along with the oscillation frequency of the horizontal axis. When the oscillation frequency is low and almost 0, the amplitude of oscillation of the rotation of core metal 64*a* in the lower pressure roller 64 is transmitted at almost a direct magnification ratio to core metal 61*a* of the upper pressure roller 61. The phase delay of core metal 61*a* of the upper pressure roller 61 is small, and core metal 61*a* of the upper pressure roller 61 rotates with oscillation, being almost synchronized with oscillation of the rotation of core metal 64*a* in the lower pressure roller 64.

When the oscillation frequency increases, the transmission magnification ratio increases little by little, and reaches a peak at a frequency FC1. Frequency FC1 is a frequency at which the upper pressure roller 61 resonates. When the oscillation frequency is frequency FC1, largest shearing force occurs between toner layer TL and sheet S. As for the phase, with oscillation frequency increasing, the phase delay of oscillation of the rotation of core metal 61*a* of the upper pressure roller 61 increases.

When the oscillation frequency increases over frequency FC1, the transmission magnification ratio decreases little by little, and the oscillation is hard to be transmitted. As for the phase, as the oscillation frequency increasing, the phase delay of oscillation of the rotation of core metal 61*a* of the upper pressure roller 61 further increases. When the oscillation frequency becomes larger than frequency FC2, core metal 61*a* of the upper pressure roller 61 oscillates at a phase almost opposite to the phase of oscillation of the rotation of core metal 64*a* in the lower pressure roller 64.

Hence, if characteristics of oscillation transmission of the rotation from core metal 64*a* in the lower pressure roller 64 to core metal 61*a* of the upper pressure roller 61 are beforehand known, the oscillation frequency can be configured to a frequency which obtains a large transmission magnification ratio, so that toner layer TL and sheet S receives large shearing force. Further, the oscillation frequency can be configured to a frequency at which core metal 61*a* of the upper pressure roller 61 oscillates with a predetermined phase difference (preferably, an opposite phase) with respect to oscillation of the rotation of core metal 64*a* in the lower pressure roller 64.

Control unit 100 may perform the rotational oscillation of the lower pressure roller 64, by a frequency in which a phase of oscillation of the rotation of core metal 61*a* of the upper pressure roller 61 is delayed with respect to a phase of oscillation of the rotation of core metal 64*a* in the lower pressure roller 64, based on characteristics of oscillation transmission of oscillation of the rotation from core metal 64*a* in the lower pressure roller 64 to core metal 61*a* of the upper pressure roller 61.

Control unit 100 may perform the rotational oscillation of the lower pressure roller 64, by a frequency in which the phase of oscillation of the rotation of core metal 64*a* in the lower pressure roller 64 and the phase of oscillation of the rotation of core metal 61*a* of the upper pressure roller 61 are opposite, based on characteristics of oscillation transmission of oscillation of the rotation from core metal 64*a* in the lower pressure roller 64 to core metal 61*a* of the upper pressure roller 61.

Further, control unit 100 may fluctuate the frequency of the rotational oscillation of the lower pressure roller 64 (in other word, period T in FIG. 4) within the required range of which the central value is a frequency in which oscillation of the rotation of core metal 61*a* of the upper pressure roller 61 resonates, based on characteristics of oscillation transmission of oscillation of the rotation from core metal 64*a* in the lower pressure roller 64 to core metal 61*a* of the upper pressure roller 61. According to the combination of a fixing system, the surface type of sheets, and melting characteristics of toner, when the frequency when performing the rotational oscillation of the lower pressure roller 64 is made constant, small gloss bands may appear on images. In such a case, periodicity of the gloss bands is lost by performing the above-mentioned control, and the gloss bands become less prominent or the gloss bands do not occur.

The upper pressure roller 61 may further include flywheel 61*d* (FIG. 3) attached the end of core metal 61*a* in the axial direction of core metal 61*a*. Typically, when the inertial of the upper pressure roller 61 (the oscillated side) is larger, the frequency at which the upper pressure roller 61 resonates, or the frequency at which the delay of the phase of the upper pressure roller 61 is large, shifts toward low frequency. Then, in case when the upper pressure roller 61 should rotate with oscillation in an effective manner even though the oscillation frequency is low, it is effective to apply inertia to the upper pressure roller 61 by installing flywheel 61*d* in the upper pressure roller 61.

Depending on the relationship between the amplitude and oscillation frequency of oscillation of the rotation of core metal 64*a* in the lower pressure roller 64, and frictional force between sheet S and surface layer 62*c*, a phenomenon of sliding by which a sheet shifts with respect to the upper pressure roller 61 and fixing belt 62 at nip portion may occur. The sliding causes deterioration of the image. Therefore, control unit 100 preferably performs the rotational oscillation of the lower pressure roller 64 at amplitude and oscillation frequency at which the sliding does not occurs.

[The Configuration of Amplitude and Oscillation Frequency in Oscillation of the Rotation of the Lower Pressure Roller]

The optimum values of the amplitude and the oscillation frequency of the oscillation of the rotation of the lower pressure roller 64 change, based on conditions, such as a friction coefficient of sheet S, basis weight of sheet S, the process speed of fixing device 60 (image forming apparatus 1), and a fixing temperature configured in fixing device 60. Therefore, the oscillation frequency and the amplitude of oscillation of the rotation of the lower pressure roller 64 are decided, in response to at least one of the conditions. The lower pressure roller 64 preferably rotates with oscillation, by the decided oscillation frequency and amplitude.

Firstly, the case in which control unit 100 decides the condition of at least one of amplitude and frequency of the oscillation of the rotation of the lower pressure roller 64 in response to the friction coefficient of sheet S will be explained.

Figure 8:
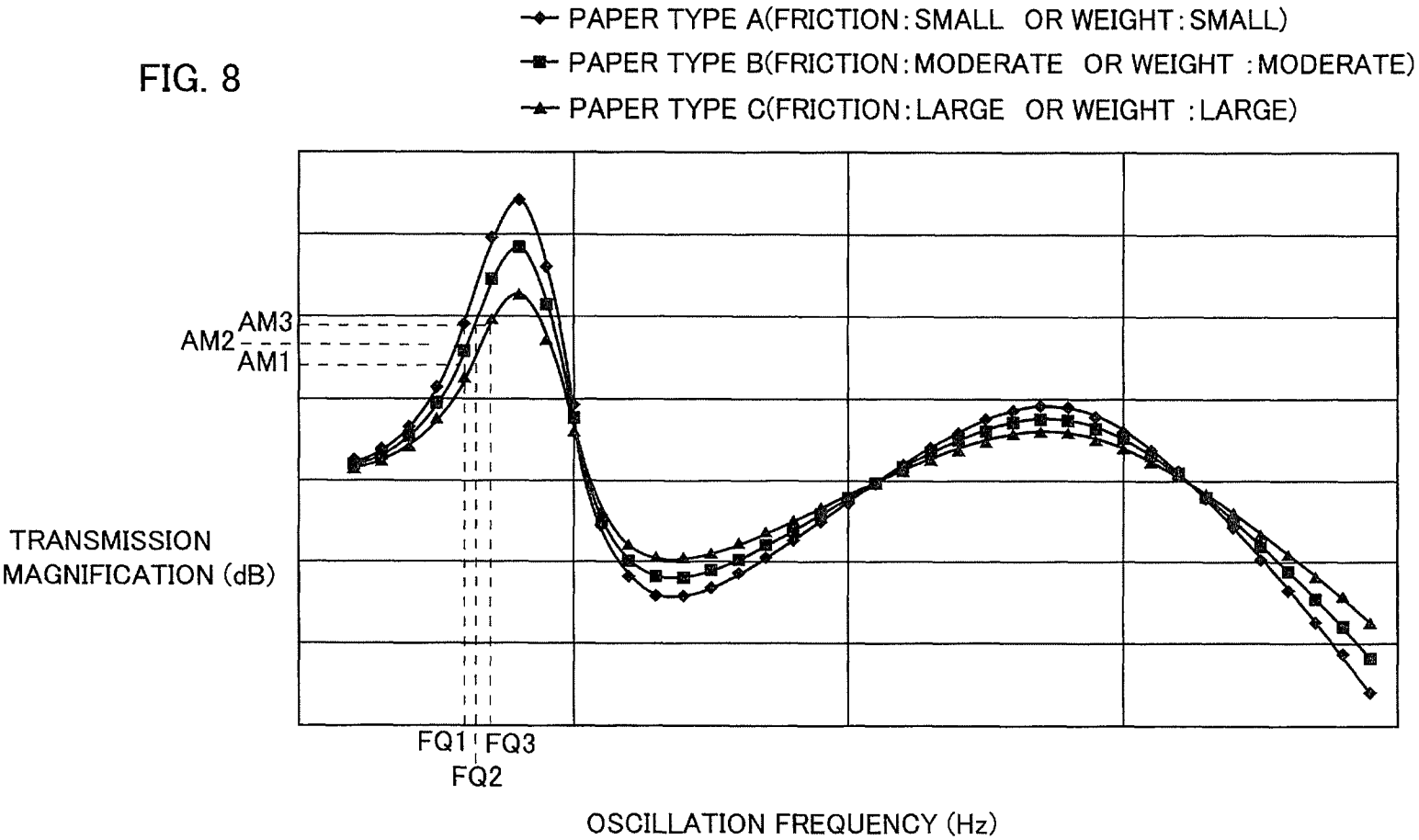
FIG. 8 shows a graph schematically indicating a change of the oscillation transmission function, caused by the difference of the friction coefficient or the basis weight of sheet S.
Figure 9:
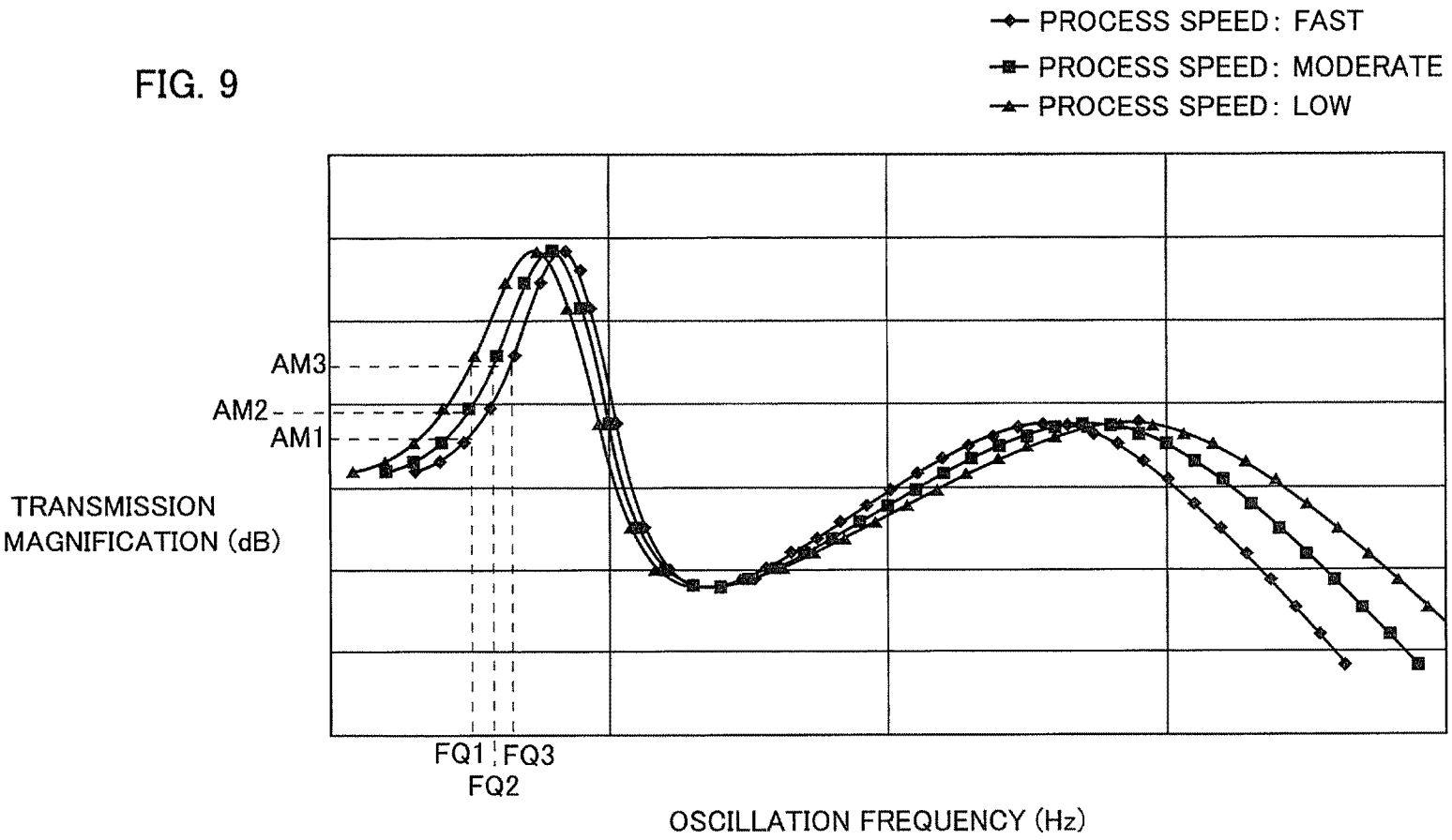
FIG. 9 shows a graph schematically indicating a change of the oscillation transmission function, caused by the difference of the process speed of fixing device 60.
Figure 10:
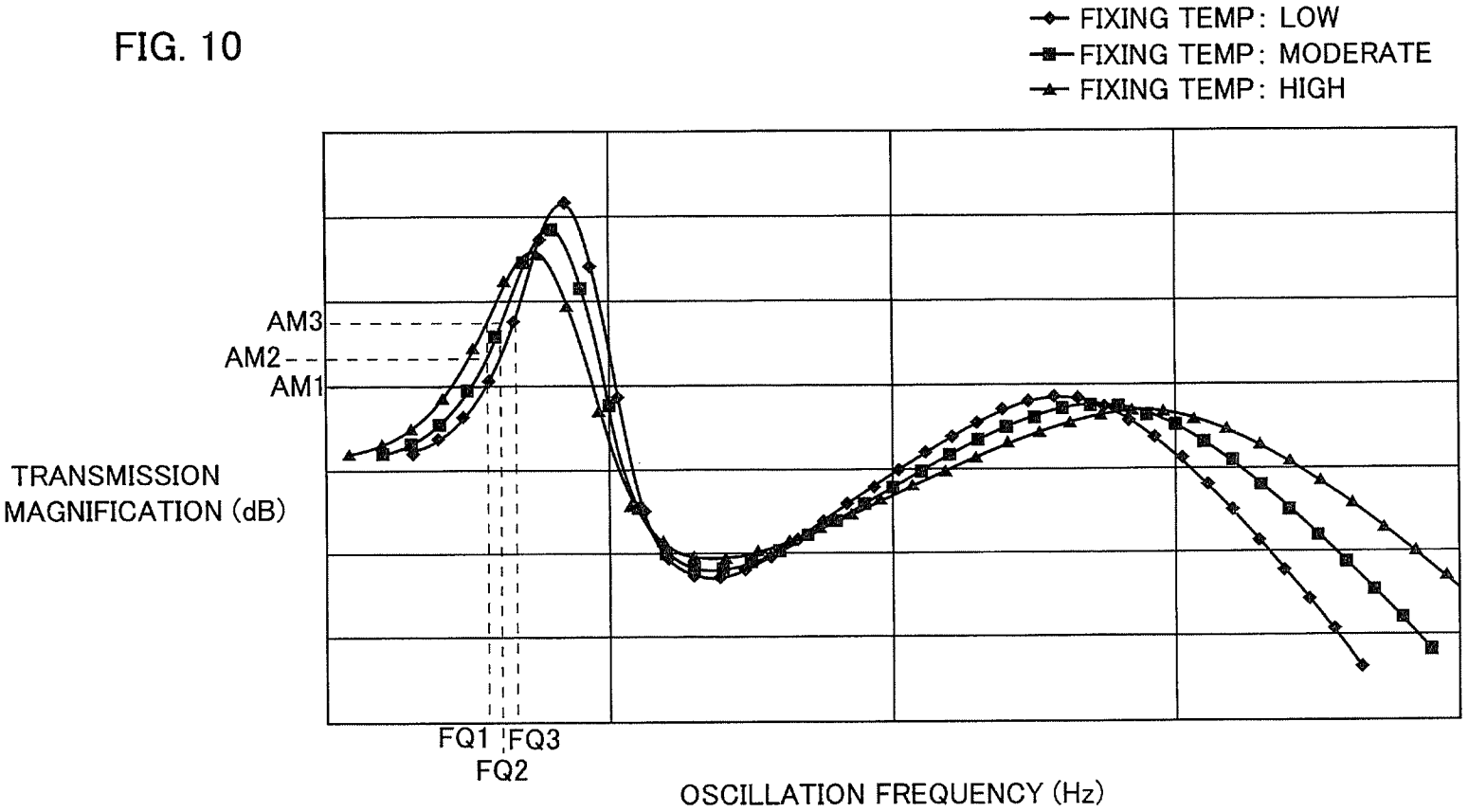
FIG. 10 shows a graph schematically indicating a change of the oscillation transmission function, caused by the difference of the fixing temperature of fixing device 60.

FIG. 8 shows a graph schematically indicating a change of the oscillation transmission function, caused by the difference of the friction coefficient or the basis weight of sheet S. In FIGS. 8 to 10, the horizontal axis shows the oscillation frequency of the lower pressure roller 64, and the vertical axis shows the transmission magnification ratio.

Referring to FIG. 8, oscillation transmission functions for the paper type A, the paper type B, and the paper type C are indicated. Here, the friction coefficient of the paper type A is small, the friction coefficient of the paper type B is moderate, and the friction coefficient of the paper type C is large.

The oscillation transmission functions differ based on the difference of the friction coefficient (the difference of the paper type) of paper sheet S which is fed. Therefore, fixing device 60 works under the most suitable condition, by deciding the condition of at least one of the amplitude and the oscillation frequency of the oscillation of the rotation of the lower pressure roller 64, in response to the friction coefficient of sheet S.

Here, it is assumed that the amplitude of the oscillation of the rotation of the lower pressure roller 64 is constant, regardless of the friction coefficient of sheet S. In this instance, the oscillation frequency of the oscillation of the rotation of the lower pressure roller 64 which makes the upper pressure roller 61 rotate with oscillation at the aimed amplitude (transmission magnification ratio AM3) is frequency FQ1 for the paper type A (the friction coefficient: small), frequency FQ2 for the paper type B (the friction coefficient: moderate), and frequency FQ3 for the paper type C (the friction coefficient: large) (FQ1<FQ2<FQ3). In this instance, to rotate the upper pressure roller 61 with oscillation at the aimed amplitude, control unit 100 makes the oscillation frequency of the oscillation of the rotation of the lower pressure roller 64 larger, when the friction coefficient of sheet S is larger.

It is assumed that the oscillation frequency of the oscillation of the rotation of the lower pressure roller 64 is constant frequency FQ1, regardless of the friction coefficient of sheet S. In this instance, the transmission magnification ratio is AM1 for the paper type C (the friction coefficient: large), AM2 for the paper type B (the friction coefficient: moderate), and AM3 for the paper type A (the friction coefficient: small) (AM1<AM2<AM3). In this instance, to rotate the upper pressure roller 61 with oscillation at the aimed amplitude, control unit 100 makes the amplitude of the oscillation of the rotation of the lower pressure roller 64 larger, when the friction coefficient of sheet S is larger.

Next, the case in which control unit 100 decides the condition of at least one of the amplitude and the frequency of the oscillation of the rotation of the lower pressure roller 64, in response to the basis weight of sheet S, will be explained.

FIG. 8 can be considered in view of the oscillation transmission function corresponding to the basis weight of sheet S. In this instance, the basis weight of the paper type A is light, the basis weight of the paper type B is moderate, and the basis weight of the paper type C is heavy.

The oscillation transmission functions differ based on the difference of the basis weight (the difference of the paper type) of paper sheet S which is fed. Therefore, fixing device 60 works under the most suitable condition, by deciding the condition of at least one of the amplitude and the oscillation frequency of the oscillation of the rotation of the lower pressure roller 64, in response to the basis weight of sheet S.

Here, it is assumed that the amplitude of the oscillation of the rotation of the lower pressure roller 64 is constant, regardless of the basis weight of sheet S. In this instance, the oscillation frequency of the lower pressure roller 64 which makes the upper pressure roller 61 rotate with oscillation at the aimed amplitude (transmission magnification ratio AM3) is frequency FQ1 for the paper type A (the basis weight: light), frequency FQ2 for the paper type B (the basis weight: moderate), and frequency FQ3 for the paper type C (the basis weight: heavy) (FQ1<FQ2<FQ3). In this instance, to rotate the upper pressure roller 61 with oscillation at the aimed amplitude, control unit 100 makes the oscillation frequency of the oscillation of the rotation of the lower pressure roller 64 larger, when the basis weight of sheet S is larger.

It is assumed that the oscillation frequency of the oscillation of the rotation of the lower pressure roller 64 is constant frequency FQ1, regardless of the basis weight of sheet S. In this instance, the transmission magnification ratio is AM1 for the paper type C (the basis weight: heavy), AM2 for the paper type B (the basis weight: moderate), and AM3 for the paper type A (the basis weight: light) (AM1<AM2<AM3). In this instance, to rotate the upper pressure roller 61 with oscillation at the aimed amplitude, control unit 100 makes the amplitude of the oscillation of the rotation of the lower pressure roller 64 larger, when the basis weight of sheet S is larger.

Next, the case in which control unit 100 decides the condition of at least one of the amplitude and the frequency of the oscillation of the rotation of the lower pressure roller 64, in response to the process speed of fixing device 60, will be explained.

FIG. 9 shows a graph schematically indicating a change of the oscillation transmission function, caused by the difference of the process speed of fixing device 60.

Referring to FIG. 9, oscillation transmission functions when the process speed of fixing device 60 is high, medium, and low are indicated.

The oscillation transmission functions differ based on the difference of the process speed of fixing device 60. Therefore, fixing device 60 works under the most suitable condition, by deciding the condition of at least one of the amplitude and the oscillation frequency of the oscillation of the rotation of the lower pressure roller 64, in response to the process speed of fixing device 60.

Here, it is assumed that the amplitude of the oscillation of the rotation of the lower pressure roller 64 is constant, regardless of the process speed of fixing device 60. In this instance, the oscillation frequency of the oscillation of the rotation of the lower pressure roller 64 which makes the upper pressure roller 61 rotate with oscillation at the aimed amplitude (transmission magnification ratio AM3) is frequency FQ1 when the process speed of fixing device 60 is slow, frequency FQ2 when the process speed of fixing device 60 is middle, and frequency FQ3 when the process speed of fixing device 60 is fast (FQ1<FQ2<FQ3). In this instance, to rotate the upper pressure roller 61 with oscillation at the aimed amplitude, control unit 100 makes the oscillation frequency of the oscillation of the rotation of the lower pressure roller 64 larger, when the process speed of fixing device 60 is faster.

It is assumed that the oscillation frequency of the oscillation of the rotation of the lower pressure roller 64 is constant frequency FQ1, regardless of the process speed of fixing device 60. In this instance, the transmission magnification ratio is AM1 when the process speed of fixing device 60 is fast, AM2 when the process speed of fixing device 60 is middle, and AM3 when the process speed of fixing device 60 is slow (AM1<AM2<AM3). In this instance, to rotate the upper pressure roller 61 with oscillation at the aimed amplitude, control unit 100 makes the amplitude of the oscillation of the rotation of the lower pressure roller 64 larger, when the process speed of fixing device 60 is faster.

Further, the case in which control unit 100 decides the condition of at least one of the amplitude and the frequency of the oscillation of the rotation of the lower pressure roller 64, in response to the fixing temperature configured in fixing device 60, will be explained.

FIG. 10 shows a graph schematically indicating a change of the oscillation transmission function, caused by the difference of the fixing temperature of fixing device 60.

Referring to FIG. 10, oscillation transmission functions when the fixing temperature of fixing device 60 is lower than the normal, when the fixing temperature of fixing device 60 is a normal temperature (medium), and when the fixing temperature of fixing device 60 is higher than the normal, are indicated.

The oscillation transmission functions differ based on the difference of the fixing temperature of fixing device 60.

Therefore, fixing device 60 works under the most suitable condition, by deciding the condition of at least one of the amplitude and the oscillation frequency of the oscillation of the rotation of the lower pressure roller 64, in response to the fixing temperature of fixing device 60.

Here, it is assumed that the amplitude of the oscillation of the rotation of the lower pressure roller 64 is constant, regardless of the fixing temperature of fixing device 60. In this instance, the oscillation frequency of the lower pressure roller 64 which makes the upper pressure roller 61 rotate with oscillation at the aimed amplitude (transmission magnification ratio AM3) is frequency FQ1 when the fixing temperature of fixing device 60 is high, frequency FQ2 when the fixing temperature of fixing device 60 is normal, and frequency FQ3 when the fixing temperature of fixing device 60 is low (FQ1<FQ2<FQ3). In this instance, to rotate the upper pressure roller 61 with oscillation at the aimed amplitude, control unit 100 makes the oscillation frequency of the oscillation of the rotation of the lower pressure roller 64 larger, when the fixing temperature of fixing device 60 is lower.

It is assumed that the oscillation frequency of the oscillation of the rotation of the lower pressure roller 64 is constant frequency FQ1, regardless of the fixing temperature of fixing device 60. In this instance, the transmission magnification ratio is AM1 when the fixing temperature of fixing device 60 is low, AM2 when the fixing temperature of fixing device 60 is normal, and AM3 when the fixing temperature of fixing device 60 is high (AM1<AM2<AM3). In this instance, to rotate the upper pressure roller 61 with oscillation at the aimed amplitude, control unit 100 makes the amplitude of the oscillation of the rotation of the lower pressure roller 64 larger, when the fixing temperature of fixing device 60 is lower.

The Effect of the Embodiment

According to the above embodiments, when sheet S passes through nip portion N, shearing force which pulls sheet S and toner layer TL toward the conveying direction, and shearing force which pulls sheet S and toner layer TL in a direction opposite to the conveying direction are applied repeatedly between toner layer TL and fixing belt 62. By the shearing forces toward the directions opposite to each other, it becomes easier for sheet S to be separated from fixing belt 62. Further, the wax component contained in toner is mashed by the shearing forces in both the directions, so that the wax component works efficiently. Herewith, even though the brake/assist function of the upper pressure roller 61 is not adopted, the separability of sheets can be improved. In consequence, separability of sheets can be effectively improved, without complication of a driving control system of the upper pressure roller 61.

Further, each of the upper pressure roller 61, fixing belt 62 and the lower pressure roller 64 includes each of rubber layers 61*b*, 62*b* and 64*b*. Hence, it becomes easier to generate a change in the transmission magnification ratio or a phase delay by the oscillation frequency, when the oscillation of the rotation of the lower pressure roller 64 is transmitted to the upper pressure roller 61. Herewith, the shearing force occurs in an effective manner.

[Others]

In the above-mentioned embodiments, an image forming apparatus equipped with a fixing device as an MFP was explained. The image forming apparatus equipped with a fixing device may be a facsimile device, a copying machine, a printer, or the like.

As substitute for the above mentioned two axes upper belt system, the fixing device may adopt a heat roller system which forms a nip portion by a fixing roller and a pressure roller.

Although the present invention has been described and illustrated in detail, it is clearly understood that the same is by way of illustrated and example only and is not to be taken by way limitation, the scope of the present invention being interpreted by terms of the appended claims.

What is claimed is:

1. A fixing device comprising:

a first and a second rotating bodies that fixes a toner image to a sheet, by holding and conveying the sheet at a nip portion, and a control unit that controls at least rotation of the first rotating body, wherein the control unit periodically changes a velocity of rotational drive of the first rotating body, at a frequency of which a period is shorter than a time needed for the sheet to pass through the nip portion, when the sheet passes through the nip portion.

2. The fixing device according to claim 1, wherein each of the first and the second rotating bodies includes a core metal, and a viscoelastic layer which is formed on an outer circumference of the core metal.

3. The fixing device according to claim 2, wherein the control unit periodically changes the velocity of the rotational drive of the first rotating body, at the frequency of which a phase of the periodical change of the rotational speed of the core metal in the second rotating body delays with respect to a phase of the periodical change of the rotational speed of the core metal in the first rotating body.

4. The fixing device according to claim 3, wherein the control unit periodically changes the velocity of the rotational drive of the first rotating body, at the frequency of which the phase of the periodical change of the rotational speed of the core metal in the first rotating body is opposite to the phase of the periodical change of the rotational speed of the core metal in the second rotating body.

5. The fixing device according to claim 3, wherein the control unit fluctuates the frequency when the velocity of the rotational drive of the first rotating body periodically changes, within a required range of which a center value is a frequency at which the periodical change of the rotational speed of the core metal in the second rotating body resonates.

6. The fixing device according to claim 2, wherein the second rotating body further includes a flywheel attached to the core metal.

7. The fixing device according to claim 1, wherein the control unit periodically changes the velocity of the rotational drive of the first rotating body, at an amplitude and a frequency at which a phenomenon of sliding in which the sheet shifts with respect to the second rotating body at the nip portion does not occur.

8. The fixing device according to claim 1, wherein the control unit periodically changes the velocity of the rotational drive of the first rotating body, by at least one of a condition of an amplitude and a condition of a frequency which were decided in response to a friction coefficient of the sheet.

9. The fixing device according to claim 8, wherein the control unit makes the amplitude when the velocity of the rotational drive of the first rotating body periodically changes constant, regardless of the friction coefficient of the sheet, and makes a frequency when the velocity of the rotational drive of the first rotating body periodically changes larger, when the friction coefficient of the sheet is larger.

10. The fixing device according to claim 8, wherein the control unit makes the frequency when the velocity of the rotational drive of the first rotating body periodically changes constant, regardless of the friction coefficient of the sheet, and makes an amplitude when the velocity of the rotational drive of the first rotating body periodically changes larger, when the friction coefficient of the sheet is larger.

11. The fixing device according to claim 1, wherein the control unit periodically changes the velocity of the rotational drive of the first rotating body, by at least one of a condition of an amplitude and a condition of a frequency which were decided in response to a basis weight of the sheet.

12. The fixing device according to claim 11, wherein the control unit makes the amplitude when the velocity of the rotational drive of the first rotating body periodically changes constant, regardless of the basis weight of the sheet, and makes a frequency when the velocity of the rotational drive of the first rotating body periodically changes larger, when the basis weight of the sheet is larger.

13. The fixing device according to claim 11, wherein the control unit makes the frequency when the velocity of the rotational drive of the first rotating body periodically changes constant, regardless of the basis weight of the sheet, and makes an amplitude when the velocity of the rotational drive of the first rotating body periodically changes larger, when the basis weight of the sheet is larger.

14. The fixing device according to claim 1, wherein the control unit periodically changes the velocity of the rotational drive of the first rotating body, by at least one of a condition of an amplitude and a condition of a frequency which were decided in response to a process speed of the fixing device.

15. The fixing device according to claim 14, wherein the control unit makes the amplitude when the velocity of the rotational drive of the first rotating body periodically changes constant, regardless of the process speed of the fixing device, and makes a frequency when the velocity of the rotational drive of the first rotating body periodically changes larger, when the process speed of the fixing device is faster.

16. The fixing device according to claim 14, wherein the control unit makes the frequency when the velocity of the rotational drive of the first rotating body periodically changes constant, regardless of the process speed of the fixing device, and makes an amplitude when the velocity of the rotational drive of the first rotating body periodically changes larger, when the process speed of the fixing device is faster.

17. The fixing device according to claim 1, wherein the control unit periodically changes the velocity of the rotational drive of the first rotating body, by at least one of a condition of an amplitude and a condition of a frequency which were decided in response to a fixing temperature configured in the fixing device.

18. The fixing device according to claim 17, wherein the control unit makes the amplitude when the velocity of the rotational drive of the first rotating body periodically changes constant, regardless of the fixing temperature configured in the fixing device, and makes a frequency when the velocity of the rotational drive of the first rotating body periodically changes larger, when the fixing temperature configured in the fixing device is lower.

19. The fixing device according to claim 17, wherein the control unit makes the frequency when the velocity of the rotational drive of the first rotating body periodically changes constant, regardless of the fixing temperature configured in the fixing device, and makes an amplitude when the velocity of the rotational drive of the first rotating body periodically changes larger, when the fixing temperature configured in the fixing device is lower.

20. The fixing device according to claim 1, wherein the control unit periodically changes the velocity of the rotational drive of the first rotating body when an anterior end of a conveying direction of the sheet is passing through the nip portion, and does not periodically change the velocity of the rotational drive of the first rotating body during at least a part of time from when the anterior end of the conveying direction of the sheet finished passing through the nip portion to when a posterior end of the conveying direction of the sheet finishes passing through the nip portion.

21. The fixing device according to claim 1, wherein the second rotating body includes a heating roller, a fixing roller, and an endless fixing belt which is laid over the heating roller and the fixing roller, and the first rotating body contacts the fixing roller with pressure via the fixing belt, and forms the nip portion with the fixing belt.

22. The fixing device according to claim 1, wherein the control unit does not rotationally drive the second rotating body when the sheet passes through the nip portion.

23. The fixing device according to claim 1, wherein the control unit rotationally drives the second rotating body when the sheet passes through the nip portion.

* * * * *